United States Patent [19]

Whitehouse

[11] 4,217,667

[45] Aug. 19, 1980

[54] DRAIN LINT SEPARATOR AND STRAINER

[76] Inventor: Stanley W. Whitehouse, 8015 S. Clippinger Dr., Cincinnati, Ohio 45243

[21] Appl. No.: 35,949

[22] Filed: May 4, 1979

[51] Int. Cl.[3] ..... A47K 1/14; E03C 1/26

[52] U.S. Cl. ..... 4/286; 4/290; 4/291; 4/652; 210/482

[58] Field of Search ..... 4/286, 287, 289, 290, 4/292, 291; 210/482, 460

[56] References Cited

U.S. PATENT DOCUMENTS

| | | | |
|---|---|---|---|
| 738,726 | 9/1903 | Lytle | 4/292 |
| 1,594,361 | 8/1926 | Frankenstein | 4/289 |
| 1,596,893 | 8/1926 | Schifter | 4/287 |
| 1,835,447 | 12/1931 | Alland | 4/287 |
| 2,065,347 | 12/1936 | Schulse | 4/290 |
| 2,075,443 | 3/1937 | Kirschner et al. | 4/287 |
| 2,364,960 | 12/1944 | Dunn | 4/291 |
| 3,696,033 | 10/1972 | Da Fano et al. | 210/482 |
| 3,742,524 | 7/1973 | Ballentine | 4/286 |

*Primary Examiner*—Henry K. Artis
*Attorney, Agent, or Firm*—Frost & Jacobs

[57] ABSTRACT

A lint separator and filtering device for preventing clogging of waste water drain openings by lint and other solid materials discharged from a clothes washer. The filter device comprises a frustro-conical shaped screen-like filter having an upper end defining an overflow opening, and a lower end containing means for attaching the filter device to a drain.

8 Claims, 5 Drawing Figures

DRAIN LINT SEPARATOR AND STRAINER

SUMMARY OF THE INVENTION

It has long been the practice for users of domestic clothes washers and the like to permit waste water containing lint and other suspended solid material to empty into a tub containing a drain opening for disposal of the waste water into the residential sanitary sewage system. After a period of time, however, the drain opening may become clogged with such lint and other solid materials, causing the tub to overflow. Furthermore, such drain clogs are often extremely difficult to remove, requiring the assistance of experienced service personnel.

Prior art workers have proposed numerous devices for collecting lint within the receiving tub to prevent clogging of waste drain lines. Typical examples are illustrated in U.S. Pat. No. 738,726, issued Sept. 8, 1903 to A. E. Lytle; U.S. Pat. No. 862,570 issued Aug. 6, 1907 to E. MacDonald; U.S. Pat. No. 1,494,882, issued May 20, 1924 to H. E. Barger; U.S. Pat. No. 1,996,279, issued Apr. 2, 1935 to W. A. Dillon; and U.S. Pat. No. 3,742,524 issued July 3, 1973 to J. Ballentine. Each of these patents illustrates a screen-like device which covers the drain opening to collect lint or other solid material suspended in the waste water. However, when the filter becomes clogged with solid material after extended use, the associated drain opening is affectively blocked, resulting in tub overflow. Since the water level in the tub may obscure the filter, the clogged condition may not become immediately known.

Another approach is suggested in U.S. Pat. No. 3,696,033, issued Oct. 3, 1972 to D. J. DeFano et al. where the upper end of the filter is open to provide an overflow opening in the event the lower filter portion becomes clogged. However, with this type of device, filtering only takes place at the lower approximate one third of the filter, so that the filter rapidly becomes clogged and filtering efficiency is lost.

The lint separator and filter device of the present invention overcomes deficiencies of prior art devices by providing effective filtering along the entire length of the filter, while including an overflow feature in the event the entire filter should become clogged with solid material. In a preferred embodiment, the filter device comprises a hollow frustro-conical shaped body portion having an open upper end forming an overflow opening and a smaller lower end configured to be force fitted into the drain opening to hold the filter device in place. The body of the device is covered with a screen-like wall containing perforations sized to facilitate passage of waste water, while preventing passage of lint and other solid material. The screen-like wall extends substantially from the upper opening to the lower opening to provide filtering capability along the entire length of the lint separator and filter device. Rigidity is provided to the structure by relatively rigid bands surrounding the upper and lower openings, and connected by a plurality of spaced web-like struts overlying the screen-like wall. Further details of the invention will become apparent from the description which follows.

DETAILED DESCRIPTION

Figure 1:
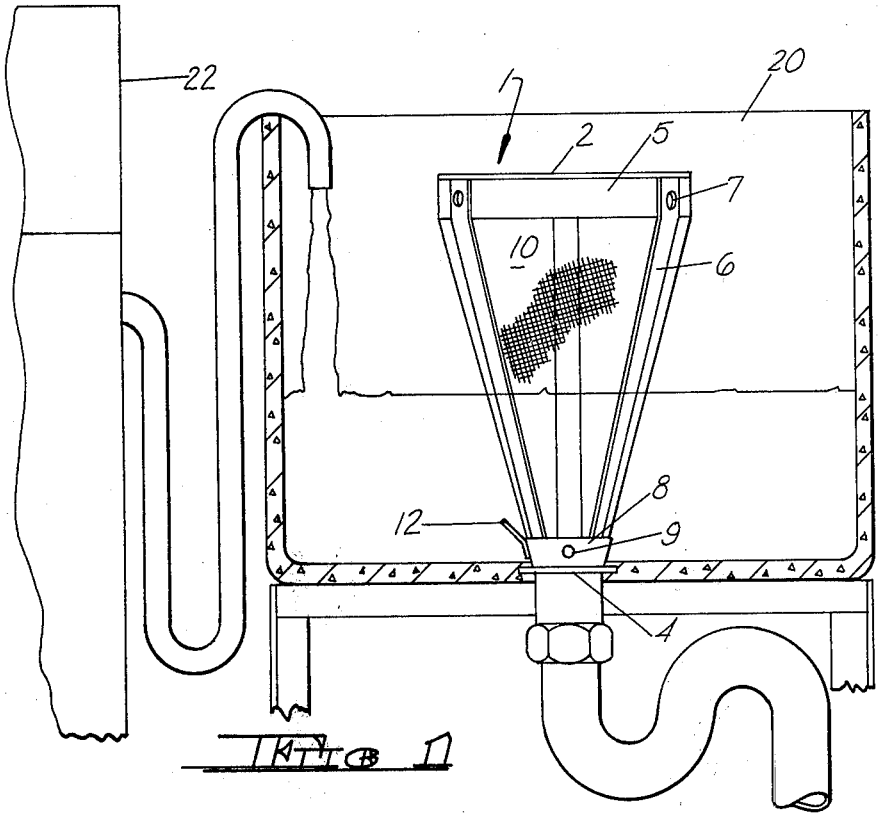
FIG. 1 is a fragmentary side elevation view, partially in cross section, of the lint separator and filter device of the present invention installed in a typical overflow tub.

The lint separator and filter device of the present invention, shown generally at 1, is generally frustoconical in shape, with the open upper end 2 forming an overflow opening, and the open lower end 3 being of smaller diameter than upper end 2 for passing filtered waste water to tub drain 4. In one embodiment, upper end 2 is formed by a relatively rigid metallic band 5 oriented transversely to the longitudinal axis of filter device 1 and supported at spaced points along its outer circumference by a plurality of spaced web-like struts, one of which is shown at 6, attached to band 5 by means of rivets or the like 7. The lower ends of struts 6 slope downwardly and inwardly and are connected to the inner circumferential surface of lower band 8 by suitable rivets or the like 9.

Figure 3:
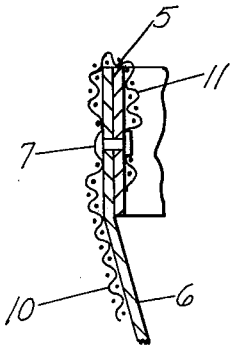
FIG. 3 is a cross sectional view taken along section line 3—3 of FIG. 2.
Figure 4:
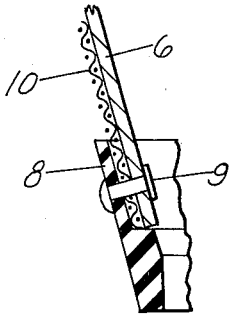
FIG. 4 is a cross sectional view taken along section line 4—4 of FIG. 2.

A conically-shaped screen or screen-like wall 10 overlies struts 6 and extends between upper end 2 and lower end 3, being connected at its ends as best shown in FIG. 3 and FIG. 4. At the upper end, screen 10 is folded over the upper edge of band 5 as at 11, and secured to the outer and inner surfaces of band 5, respectively, by means of the inner and outer heads of rivet 7.

In a similar manner, the lower end of wall 10 is sandwiched between the lower end of strut 6 and the inner surface of band 8, and held in place by rivet 9. It will be understood that this construction permits filtering to take place along the entire length of filter device 1 substantially from upper end 2 to lower end 3.

In general, wall 10 will be constructed of a metallic or cloth screen having a plurality of perforations dimensioned to readily pass waste water from the outer surface of wall 10 to the hollow interior of filter device 1, while preventing the passage of lint and other solid material. It has been found that for the particular application of filtering lint discharged from clothes washers, a wall having perforations or openings of 0.004 in.$^2$ which can be readily obtained by wire mesh of approximately 1/16 in. prevents the type of lint commonly discharged from clothes from passing through the filter wall.

Figure 2:
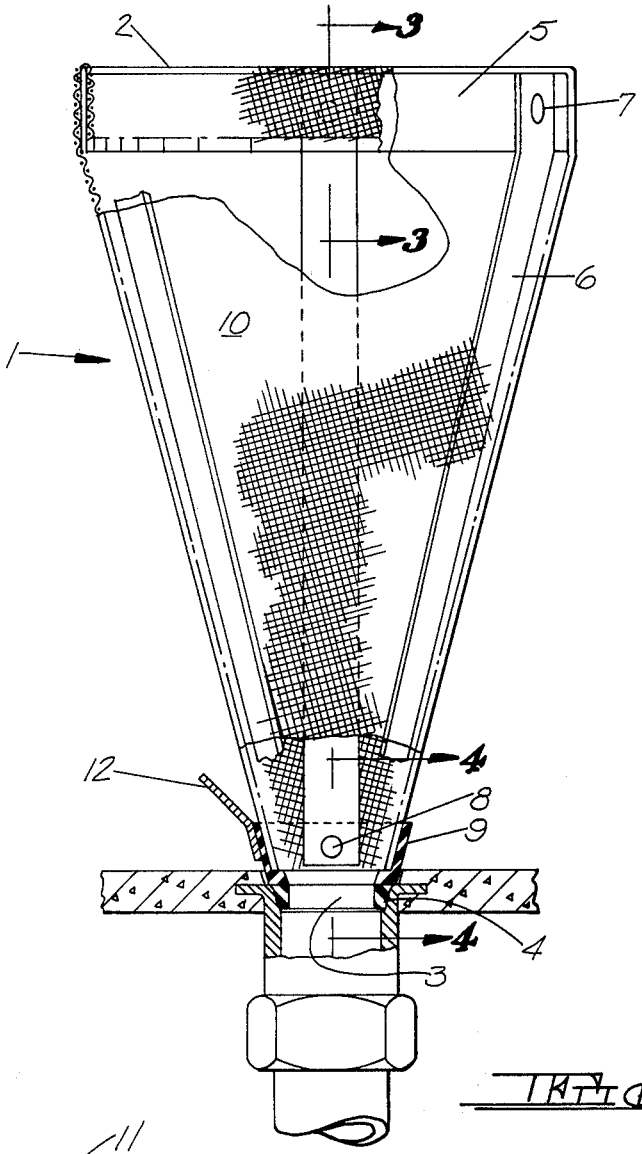
FIG. 2 is a fragmentary side elevation view, partially in cross section, of the lint separator and filter device of the present invention.
Figure 5:
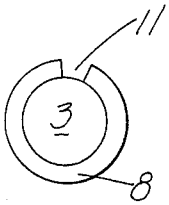
FIG. 5 is a fragmentary bottom plan view of the lower end of the lint separator and filter device of the present invention illustrating an alternative construction for the drain connection.

The lower end 3 of filter device 1 also contains means for attaching the device to a suitable outlet drain 4. In a preferred embodiment, all or part of band 8 is constructed of a resilient deformable material such as rubber or the like, of slightly greater outside diameter than the inner diameter of drain 4. Consequently, as best shown in FIG. 2, when the lower end 3 of filter device 1 is forced into the drain opening, resilient band 8 will be compressed and urged outwardly against the inner surface of drain 4 to firmly hold the device in place against the force of water entering the associated tub. FIG. 5 illustrates an alternative construction for facilitating the force fit of the lower end of the device within the drain opening, and includes a gap or split area 11 extending partially or completely along lower band 8. It will be understood that either construction permits filter device 1 to be easily accommodated in variously sized drain openings.

Additional means, such as handle 12, may be attached to the outer surface of lower band 8 to facilitate inserting and removing device 1 from drain opening 4.

As described and illustrated, lint separator and filter device 1 generally comprises a hollow tubular structure having a perforated or screen-like outer wall for filtering lint and other solid material from waste water. In the embodiment shown, filter device 1 is provided in an inverted frustro-conical shape, with lower end 3 of smaller diameter than upper end 2 in order to increase the filtering efficiency of the device. The sloping sides of wall 10 permit the waste water containing suspended solid material to strike the outer surface of the device at an angle, thereby increasing the effective filtering area of the wall. Furthermore, as the water level within the tub rises, increased surface area is presented, thereby increasing the filtering efficiency. In general, filter device 1 will be constructed of a height slightly less than the flood level of tub 20 as illustrated in FIG. 1. This prevents waste water 21 discharged by clothes washer 22 to overflow into upper opening 2 of device 1 in the event the outer surface of the filter becomes clogged. In operation, when wall 10 becomes sufficiently clogged with solid matter, it may be easily cleaned with a small brush, or held under running water to dislodge the collected material.

It will be understood that various changes in the details, materials, steps and arrangements of parts, which have been herein described and illustrated in order to explain the nature of the invention, may be made by those skilled in the art within the principle and scope of the invention as expressed in the appended claims. For example, while for purposes of an exemplary showing, the lint separator and filter device of the present invention has been described as containing a screen-like perforated wall, it will be understood that the entire device may be of a substantially unitary construction of rubber, plastic or the like containing a perforated wall of the aforementioned construction. In this alternative embodiment, upper band 5, lower band 8, and vertical struts 6 may be omitted, or modified as required to give the structure the necessary rigidity.

The embodiments of the invention in which an exclusive property or privilege is claimed are as follows:

1. A lint separator and filter device for preventing clogging of waste water drain openings by lint and other solid material discharged from a clothes washer or the like comprising:

a hollow tubular body portion having an open upper end forming an overflow opening, an open lower end spaced from said upper end for passing filtered waste water to the drain, and a screen-like wall containing a plurality of perforations extending substantially from said upper opening to said lower opening, said perforations being dimensioned to permit the passage of waste water but prevent the passage of lint and other solid material to the interior of said device; and means attached to said lower end for connecting said device to the drain;

the passageway extending between said upper end and said lower end permitting the unobstructed passage of water and solid material to said drain from waste water overflowing said upper end.

2. The filter device according to claim 1 wherein said device is frustro-conical shaped, said lower end being of smaller diameter than said upper end.

3. The filter device according to claim 1 wherein said perforations comprise openings of about 0.004 square inches.

4. The filter device according to claim 1 wherein said connecting means comprises a resilient ring extending outwardly from and surrounding said lower end of said device, said ring being of slightly larger diameter than the drain opening so that said ring may be force fitted into the opening to securely hold said filter device in place.

5. The filter device according to claim 4 wherein said ring contains a gap to facilitate compression when said ring is fitted into the drain opening.

6. The filter device according to claim 1 wherein said upper end includes a relatively rigid band surrounding said upper opening and said lower end includes a relatively rigid band surrounding said lower opening, said bands being connected by a plurality of spaced web-like struts.

7. The filter device according to claim 6 wherein said lower band includes an outwardly projecting handle to facilitate insertion and removal of said filter device in the drain opening.

8. The filter device according to claim 1 wherein said filter is of such a height that said upper end is positioned slightly below the flood level of an overflow tub associated with the drain.

* * * * *